US006549167B1

(12) United States Patent
Yoon

(10) Patent No.: US 6,549,167 B1
(45) Date of Patent: Apr. 15, 2003

(54) PATCH ANTENNA FOR GENERATING CIRCULAR POLARIZATION

(75) Inventor: Jong Cheol Yoon, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/034,310

(22) Filed: Jan. 3, 2002

(30) Foreign Application Priority Data

Sep. 25, 2001 (KR) ..... 2001-59434

(51) Int. Cl.[7] ..... H01Q 1/38; H01Q 1/24
(52) U.S. Cl. ..... 343/700 MS; 343/702
(58) Field of Search ..... 343/700 MS, 702, 343/767, 846

(56) References Cited

U.S. PATENT DOCUMENTS 6,281,848 B1 * 8/2001 Nagumo et al. ..... 343/700 MS

* cited by examiner

*Primary Examiner*—Michael C. Wimer

(74) *Attorney, Agent, or Firm*—Lowe Hauptman Gilman & Berner, LLP

(57) ABSTRACT

Disclosed herein is a surface mounted chip antenna. The surface mounted chip antenna has a dielectric block, a ground electrode, a feeding electrode, and a radiation electrode. The dielectric block is constructed in the form of a rectangular solid having opposite first and second major surfaces. The ground electrode is formed on the first major surface. The feeding electrode is formed on at least one side surface of the dielectric block. The radiation electrode is comprised of a radiation portion formed on the second major surface, an open portion formed to be spaced apart from the feeding electrode, and a short portion formed for coupling the radiation portion with the ground electrode.

8 Claims, 4 Drawing Sheets

PATCH ANTENNA FOR GENERATING CIRCULAR POLARIZATION

BACKGROUND OF THE INVENTION

1. Field of the Invention

The present invention relates generally to patch antennas for circular polarization, and more particularly to a patch antenna, in which a slot region is arranged in a radiation portion formed on a surface of a dielectric block substantially having a rectangular solid shape, thus enabling the patch antenna to substantially generate circular polarization using the radiation portion surrounding the slot region.

2. Description of the Prior Art

Recently, communication terminals using circularly polarized wave signals, such as a GPS (Global Positioning System), a DAB (Digital Audio Broadcasting), and an ETCS (Electronic Toll Collection System) have been used. As such communication systems are widely used, the miniaturization of antennas is required for them to be suitable for the communication terminals.

FIG. 1 shows a regular square patch antenna 10 as an example of such a conventional circular polarization antenna. Referring to FIG. 1, the regular square patch antenna 10 comprises a plate ground electrode 8 formed on the substantially entire regions of a first major surface 2*a* of a dielectric substrate 2, a radiation electrode 5 formed on a second major surface 2*b* to have a substantially regular square shape, and a feeding line 7 connected to the radiation electrode 5 while penetrating the substrate 2 from the first major surface 2*a*. The radiation electrode 5, which is a patch of a regular square, has substantially the same length as a half of an effective wavelength of a frequency. Further, the radiation electrode 5 has degeneracy separation portions 9 formed thereon by diagonally cutting two opposite corners to generate circular polarization. Accordingly, the radiation electrode 5 is separated into two orthogonal modes by the degeneracy separation portions 9. At this time, the radiation electrode 5 generates two resonance currents having a phase difference of 90 degrees therebetween and having the same intensity in the two orthogonal modes by appropriately adjusting each size $\Delta s$ of the cut pieces of the corners, thus forming circular polarization antenna.

Such a regular square patch antenna 10 is required to be mounted on a printed circuit board (PCB) so as to be used in conjunction with various kinds of mobile communication terminals. However, as described above, a side of the radiation electrode 5, which is a regular square patch, must have a length of $\lambda/2$, where $\lambda$ is a wavelength of a resonance frequency. Therefore, in order to miniaturize the antenna to be mounted on the PCB, the antenna must employ a ceramic body with a high dielectric constant as a substrate. However, when the antenna uses a dielectric substrate of a ceramic body, the regular square patch antenna has a problem that it has a narrow usable frequency bandwidth and is decreased in its radiation efficiency.

In order to solve the above problem due to miniaturization of the antenna, a short-type inverse F-shaped patch antenna 20 using an Electro-Magnetic Coupling (EMC) feeding method of FIG. 2*a* is utilized. The inverse F-shaped patch antenna 20 comprises a dielectric substrate 12 having an approximately rectangular hexahedron shape. Here, a ground electrode 13 is formed on a first major surface 12*a* of the substrate 12, and a radiation electrode 15 of an inverse F-shaped is formed on a second major surface 12*b* and extended to a side surface adjacent to the major surface 12*b*.

A high frequency signal source transmitted to a feeding electrode 17 formed on another side surface is transmitted to the inverse F-shaped radiation electrode 15 through capacitance between the feeding electrode 17 and the radiation electrode 15. Then, the patch antenna 20 radiates some of electric fields generated between the radiation electrode 15 and the ground electrode 13 into space, such that the inverse F-shaped patch antenna 20 can operate as an antenna. In such an inverse F-shaped patch antenna 20, a length (l) of the radiation electrode 15 is $\lambda/4$, where $\lambda$ is a wavelength of a resonance frequency, thus satisfying the miniaturization requirement of the antenna, and enabling the inverse F-shaped patch antenna to be preferably mounted on a PCB of a communication terminal.

However, the inverse F-shaped patch antenna is disadvantageous in that it has a great propagation loss due to its linear polarization characteristic, compared with antennas having circular polarization characteristic, and thereby it cannot be an effective solution for the problem.

Further, the inverse F-shaped patch antenna is further disadvantageous in that beam radiated backward is weak due to a necessary design of the mobile communication terminal, thus decreasing the transmission/reception performance of the mobile communication terminal.

In other words, as shown in FIG. 2*b*, the patch antenna is mounted on a backside of the terminal (in the case of a mobile phone, a position of a battery) according to the design structure of the terminal such as a normal mobile phone. In this case, the patch antenna hardly radiates beam backward by the inverse F-shaped radiation electrode. Thereby, the mobile communication terminal is decreased in its transmission/reception performance due to the weak beam radiated in a forward direction of the terminal (in the case of the mobile phone, in a direction of a speaker).

Subsequently, such antenna technical fields require an antenna having a small size to be suitably mounted on the mobile communication terminal, while having circular polarization characteristic. Moreover, in consideration of characteristic of a mounting structure of a normal mobile phone, there is required a new antenna having an intensified transmission/reception function by controlling a quantity of beam radiated backward.

SUMMARY OF THE INVENTION

Accordingly, the present invention has been made keeping in mind the above problems occurring in the prior art, and an object of the present invention is to provide a surface mounted chip antenna, which has circular polarization characteristic by forming a slot region in a radiation portion of a radiation electrode, though employing an EMC feeding method.

Another object of the present invention is to provide a surface mounted chip antenna for controlling beam radiated backward by reducing a size of a side pattern of a dielectric substrate.

In order to accomplish the above object, the present invention provides a surface mounted chip antenna, comprising a dielectric block constructed in the form of a rectangular solid having opposite first and second major surfaces; a ground electrode formed on the first major surface; a feeding electrode formed on at least one side surface of the dielectric block; and a radiation electrode comprised of a radiation portion formed on the second major surface, an open portion formed to be spaced apart from the feeding electrode, and a short portion formed for coupling the radiation portion with the ground electrode; wherein the feeding electrode is spaced apart from the open and short portions of the radiation electrode and the ground electrode by a gap region formed by exposing the dielectric block; wherein the radiation electrode includes a slot region formed by exposing the dielectric block, the slot region having one end connected to the gap region adjacent to the open portion.

In a preferred embodiment of this invention, the slot region is formed in a shape of an L, such that distribution of current generated from the radiation electrode is substantially circular in shape.

Further, in the chip antenna, the open and the short portions can be formed on the same side surface, in which the open portion is arranged in the left side of the slot region, and the short portion is arranged in the right side of the slot region.

Further, in the preferred embodiment of this invention, a quantity of beam radiated in a direction of the first major surface can be adjusted by forming a side pattern extended from the radiation electrode on a side surface opposite to the side surface on which the feeding electrode is formed.

Moreover, the chip antenna of this invention can save the dielectric material and reduce its weight by forming a through hole penetrating opposite side surfaces of the dielectric substrate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 3A:
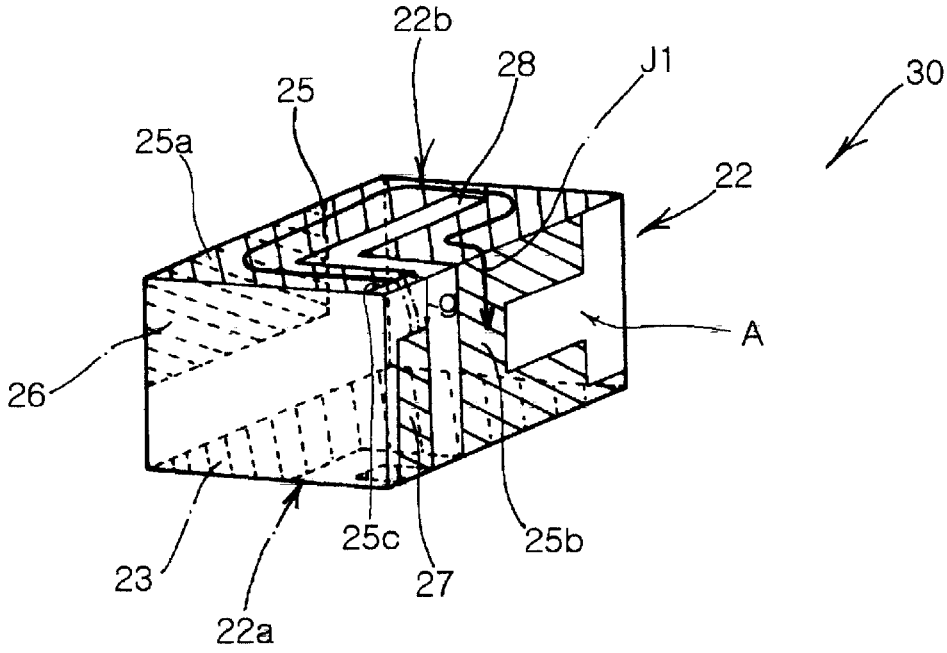
FIG. 3*a* is a perspective view showing a surface mounted chip antenna according to a preferred embodiment of the present invention.

FIG. 3*a* is a perspective view showing a surface mounted chip antenna 30 according to a preferred embodiment of the present invention. The surface mounted chip antenna 30 having a rectangular solid shape comprises a dielectric block 22 having opposite first and second major surfaces 22*a* and 22*b*, and side surfaces substantially perpendicular to the major surfaces 22*a* and 22*b*. Further, a ground electrode 23 is arranged on the first major surface 22*a*, and a radiation electrode 25 is arranged around the second major surface 22*b*. A feeding electrode 27 is formed to be extended from a portion of the first major surface 22*a* to a side surface adjacent to the major surface 22*a*.

The radiation electrode 25 is comprised of a radiation portion 25*a* formed on the second major surface 22*b*, a short portion 25*b* formed for coupling the radiation portion 25*a* and the ground electrode 23, and an open portion 25*c* formed to be spaced apart from the feeding electrode 27. As shown in FIG. 3*a*, the feeding electrode 27 is spaced apart from the open portion 25*c*, the short portion 25*b* and the ground electrode 23 by a gap region formed by exposing the dielectric block 22.

Especially, capacitive coupling can be formed between the feeding electrode 27 and the open portion 25*c* by the gap region. If necessary, the open portion 25*c* can be extended to a side surface on which the feeding electrode 27 is formed so as to adjust a distance (g) between the open portion 25*c* and the feeding electrode 27. In the preferred embodiment, it is shown that the open portion 25*c* is only formed on the second major surface 22*b*.

Further, the radiation portion 25*a* of the chip antenna 30 according to the preferred embodiment of this invention includes a slot region 28 having an L shape, as shown in FIG. 3*a*. The L-shaped slot region 28 is formed in a portion of the radiation portion 25*a*, and its one end is extended to the gap region formed between the open portion 25*c* and the short portion 25*b* of the radiation electrode 25. The slot region 28 is formed in a shape of an L so as to provide a substantially circular current flow by forming a pattern of the radiation portion 25*a* along the outline of the second major surface 22*b*.

As described above, the current flow of the radiation electrode 25, formed by the feeding electrode 27, is started from the open portion 25*c* of the radiation electrode 25 toward the short portion 25*b* connected to the ground electrode 23. In other words, circular current flow Ji can be substantially formed on the radiation electrode 25 along the slot region 28.

Further, preferably the current flow J1 is toward the ground electrode 23 through the short portion 25*b* adjacent to the gap region such that the current flow J1 provides circular polarization more effectively. In order to realize this, an open region A is additionally formed in a portion of the short portion 25*b*, opposite to the gap region. Accordingly, the current flowing to the ground electrode 23 flows only through the short portion 25*b* adjacent to the gap region due to the open region A. Subsequently, the current flow J1 for more effectively providing the circular polarization can be obtained.

Hereinafter, the operation of generating the circular polarization by the surface mounted chip antenna 30 shown in FIG. 3*a* is described in detail. First, when a high frequency signal source is applied to the feeding electrode 27, the applied high frequency signal source is applied to the radiation electrode 25 through the capacitive coupling (electromagnetic (EM) coupling) formed on a region (g) between the feeding electrode 27 and the open portion 25*c* of the radiation electrode 25. The high frequency signal (current) flows from the open portion 25*c* to the short portion 25*b* along the slot region 28. The current flow J1 is formed as a locus of about circle shape. Therefore, the surface mounted chip antenna 30 can generate substantially circular polarization using the slot region 28 formed in the radiation portion 25*a*.

Figure 1:
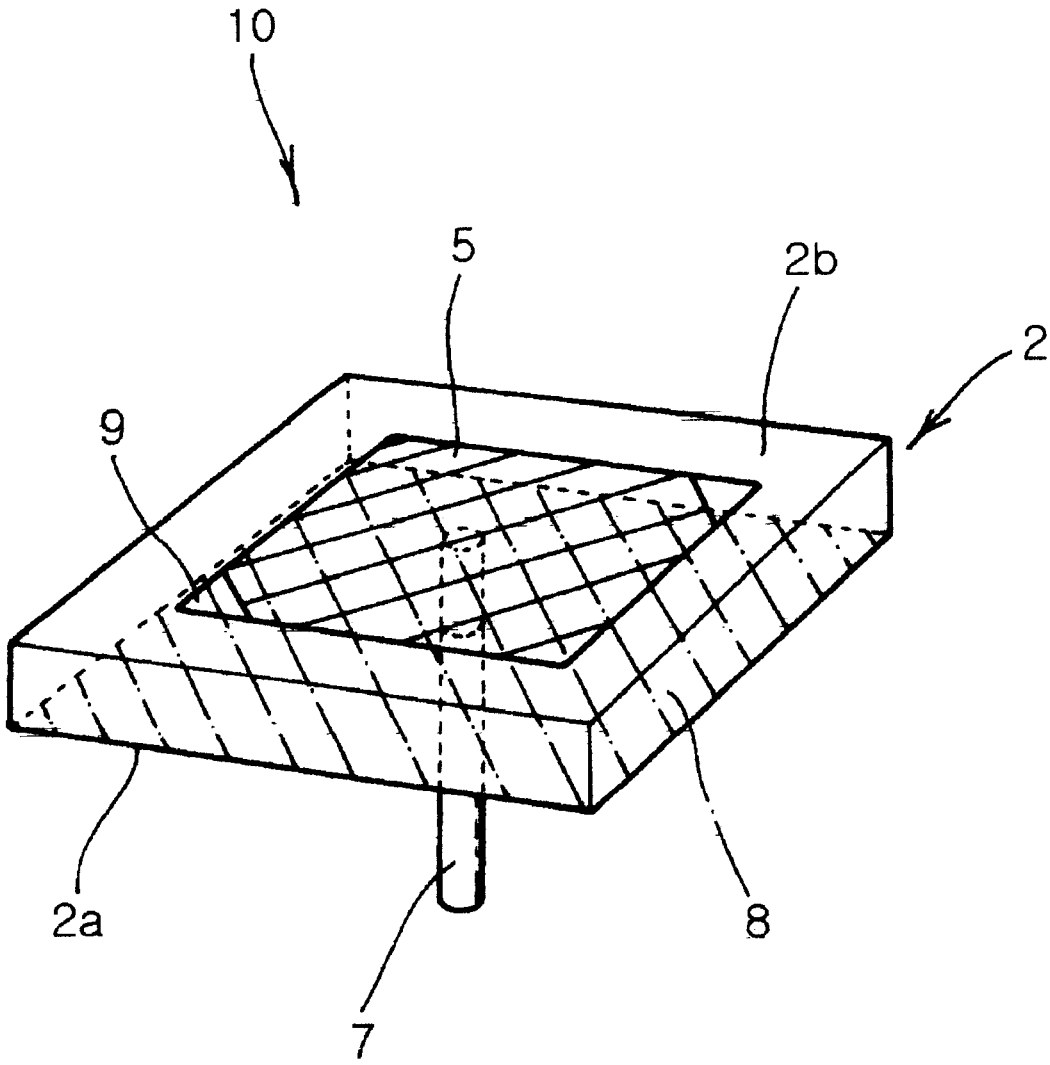
Prior Art FIG. 1
FIG. 1 is a perspective view showing a conventional regular square patch antenna.
Figure 2A:
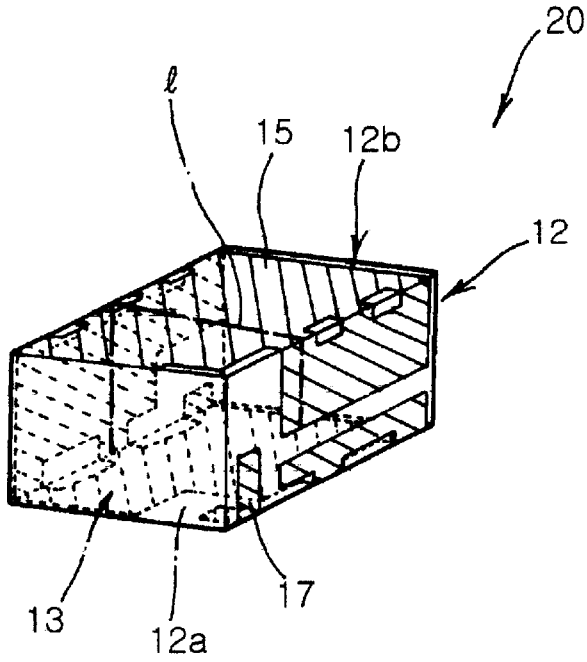
Prior Art FIG. 2a
FIG. 2*a* is a perspective view showing a conventional inverse F-shaped patch antenna.
Figure 2B:
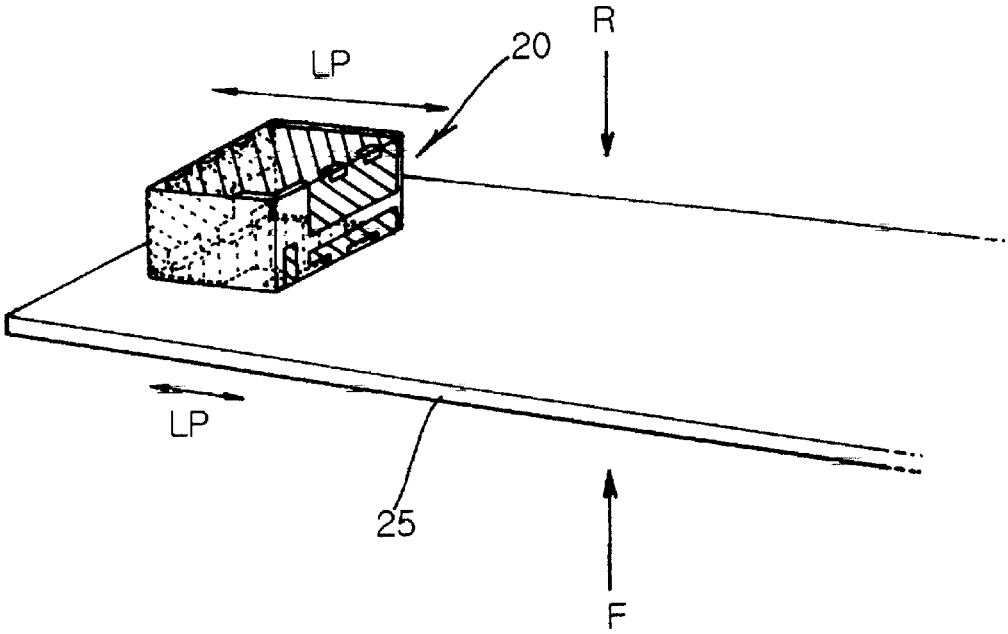
Prior Art FIG. 2b
FIG. 2*b* is a view showing a printed circuit board (PCB) of a mobile communication terminal, on which the patch antenna of FIG. 2*a* is mounted.

Further, because a length of the patch of the radiation electrode 25, which is formed along the slot region 28, is $\lambda/4$ ($\lambda$ is a wavelength of a resonance frequency) in the surface mounted chip antenna 30, the chip antenna 30 can be miniaturized similarly to the patch antenna of FIG. 2*a*.

Moreover, in the preferred embodiment of this invention, a side pattern 26 extended from the radiation electrode 25 and formed on a side surface opposite to the side surface on which the feeding electrode 27 is formed is additionally provided. In this case, the intensity of beam radiated in a direction of the first major surface 22*a* can be controlled by adjusting a size of the side pattern 26 and a distance between the side pattern 26 and the ground electrode 23. In other words, as the size of the side pattern 26 is reduced and the distance between the side pattern 26 and the ground electrode 23 is increased, the beam radiated in a direction of the first major surface 22*a* can be intensified.

Figure 3B:
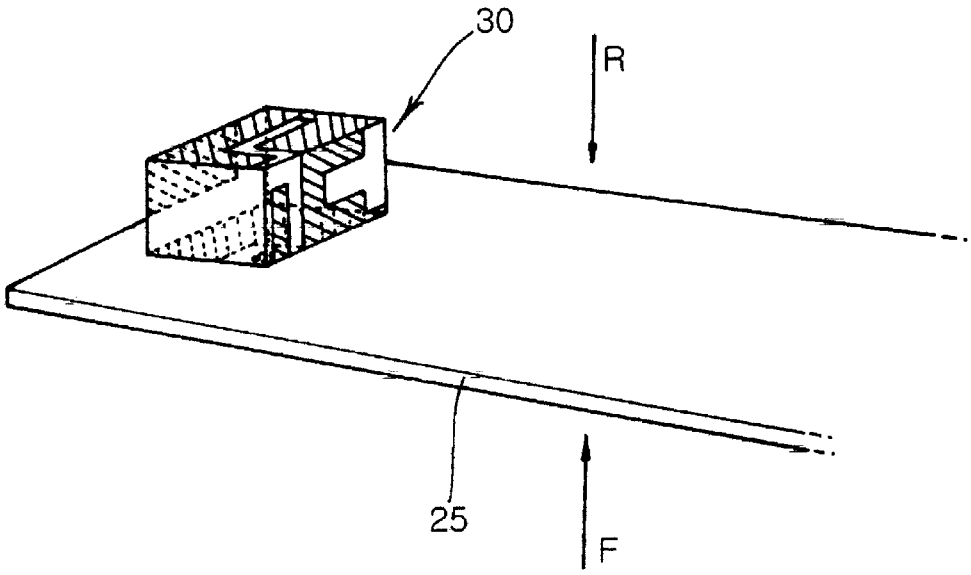
FIG. 3*b* is a view showing a PCB of a mobile communication terminal, on which the chip antenna of FIG. 3*a* is mounted.

FIG. 3*b* is view showing a printed circuit board (PCB) of a mobile communication terminal, on which the surface mounted chip antenna 30 of FIG. 3*a* is mounted. A surface for mounting the chip antenna 30 is in a battery installation direction R as a back surface of the mobile communication terminal, while its opposite surface is in a speaker direction F as a front surface of the mobile communication terminal. Particularly, it is preferable to mount the surface mounted chip antenna 30 such that the side pattern 26 of the chip antenna 30 is toward the upper side of the mobile communication terminal in order to maximize an effect of the side pattern 26 for adjusting beam radiated backward. A quantity of beam radiated backward in a direction of the first major surface 22*a* can be controlled by adjusting the size of the side pattern 26 and the distance between the side pattern 26 and the ground electrode 23. In other words, strong beam can be radiated backward by reducing the size of the side pattern 26, and increasing the distance between the side pattern 26 and the ground electrode 23, thus improving the transmission/reception efficiency of the antenna.

Figure 4:
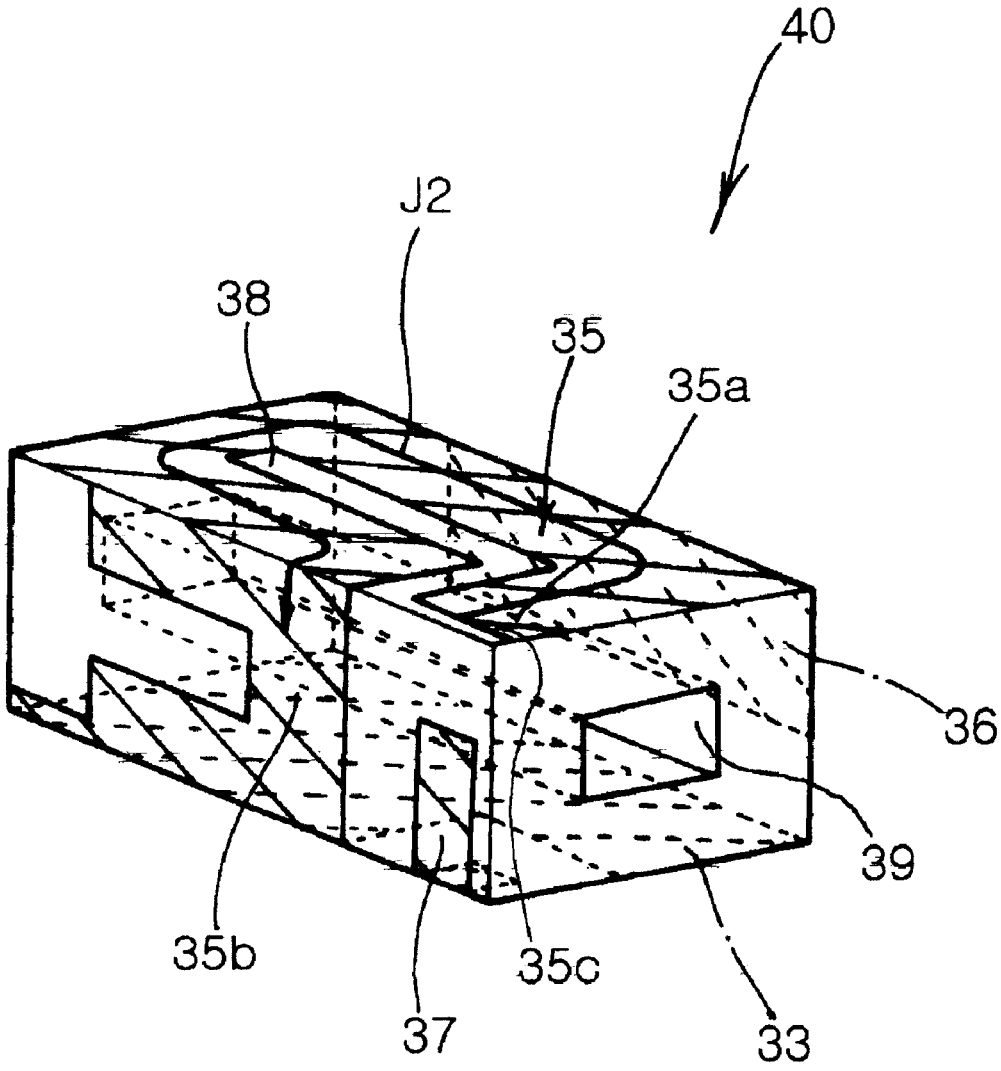
FIG. 4 is a perspective view showing another surface mounted chip antenna according to another preferred embodiment of the present invention.

FIG. 4 is a perspective view showing another surface mounted chip antenna 40 according to another preferred embodiment of the present invention. Referring to FIG. 4, in the surface mounted chip antenna 40, a radiation portion 35*a* of a radiation electrode 35 is formed on a left side around a slot region 38 close to a side surface, and an open portion 35*c* of the radiation electrode 35 is formed on a right side thereof. Therefore, a current flow J2 formed on the radiation electrode 35 is started from the open portion 35*c* of the radiation electrode 35 toward the short portion 35*b* of the radiation electrode 35 along the slot region 38 on the radiation portion 35*a*. Therefore, the current flow J2 is formed counterclockwise.

Further, the surface mounted chip antenna 40 has a through hole 39 formed to penetrate opposite side surfaces. Accordingly, the chip antenna 40 can save a dielectric material of a volume corresponding to the through hole 39. Thereby, the chip antenna 40 is advantageous in that it can be decreased in its entire weight.

As described above, the present invention provides a surface mounted chip antenna, which has circular polarization characteristic by forming a slot region which is formed on a portion of a radiation electrode and has one end extended to a side surface between an open portion and a short portion of the radiation electrode. Further, the chip antenna according to another preferred embodiment of the present invention may additionally provide a side pattern for adjusting beam radiated backward.

Further, the present invention is advantageous in that, as a length of a patch formed along a slot region on the radiation electrode is $\lambda/4$ ($\lambda$ is a wavelength of a resonance frequency), the chip antenna having circular polarization characteristic can be manufactured in a small size, and transmission/reception sensitivity of the chip antenna can be greatly improved by intensifying beam radiated backward when the chip antenna is mounted on mobile communication terminals.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A surface mounted chip antenna, comprising:

a dielectric block constructed in the form of a rectangular solid having opposite first and second major surfaces;

a ground electrode formed on the first major surface;

a feeding electrode formed on at least one side surface of the dielectric block; and a radiation electrode comprised of a radiation portion formed on the second major surface, an open portion formed to be spaced apart from the feeding electrode, and a short portion formed for coupling the radiation portion with the ground electrode;

wherein the feeding electrode is spaced apart from the open and short portions of the radiation electrode and the ground electrode by a gap region formed by exposing the dielectric block;

wherein the radiation electrode includes a slot region formed by exposing the dielectric block, the slot region having one end connected to the gap region adjacent to the open portion.

2. The surface mounted chip antenna according to claim 1, wherein the slot region is formed in an L shape whose one end is connected to the gap region-adjacent to the open portion.

3. The surface mounted chip antenna according to claim 1, wherein the open portion is arranged in the left side around the one end of the slot region, which is connected to the gap region, and the radiation portion adjacent to the short portion is arranged in the right side thereof.

4. The surface mounted chip antenna according to claim 1, wherein both the feeding electrode and the short portion are formed on the same side surface of the dielectric block.

5. The surface mounted chip antenna according to claim 1, wherein the feeding electrode is extended to a portion of the first major surface from a side surface of the dielectric block.

6. The surface mounted chip antenna according to claim 1, further comprising an open region formed on a portion of the short portion, opposite to a portion adjacent to the gap region such that current flowing from the radiation portion to the ground electrode flows through the short portion adjacent to the gap region.

7. The surface mounted chip antenna according to claim 1, further comprising a side pattern extended from the radiation electrode and formed on a side surface opposite to the side surface on which the feeding electrode is formed.

8. The surface mounted chip antenna according to claim 1, further comprising a through hole formed to penetrate opposite side surfaces of the dielectric block.

* * * * *